US006183921B1

(12) United States Patent
Yu et al.

(10) Patent No.: US 6,183,921 B1
(45) **Date of Patent: *Feb. 6, 2001**

(54) CRACK-RESISTANT AND CURL FREE MULTILAYER ELECTROPHOTOGRAPHIC IMAGING MEMBER

(75) Inventors: Robert C. U. Yu, Webster; William W. Limburg; Merlin E. Scharfe, both of Penfield; David H. Pan, Rochester; Dale S. Renfer, Webster; Richard L. Schank, Pittsford; Surendar Jeyadev, Rochester, all of NY (US)

(73) Assignee: Xerox Corporation, Stamford, CT (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/787,057

(22) Filed: Dec. 6, 1996

Related U.S. Application Data

(63) Continuation of application No. 08/492,529, filed on Jun. 20, 1995, now abandoned.

(51) Int. Cl.[7] ..... G03G 5/047

(52) U.S. Cl. ..... 430/58.7; 430/59.1; 430/73; 430/96

(58) Field of Search ..... 430/58, 59, 64, 430/73, 135, 127, 96, 58.7, 59.1, 59.4

(56) References Cited

U.S. PATENT DOCUMENTS

| | | | | |
|---|---|---|---|---|
| 3,121,006 | | 2/1964 | Middleton | 430/31 |
| 3,357,989 | | 12/1967 | Byrne et al. | 430/32 |
| 3,442,781 | | 5/1969 | Weinberger | 430/78 |
| 3,937,631 | * | 2/1976 | Eisenhut | 430/58.6 |
| 4,053,311 | * | 10/1977 | Limburg et al. | 430/58.3 |
| 4,278,747 | * | 7/1981 | Murayama et al. | 430/82 |
| 4,286,033 | | 8/1981 | Neyhart et al. | 430/58.6 |
| 4,291,110 | | 9/1981 | Lee | 430/58.8 |
| 4,338,387 | | 7/1982 | Hewitt | 430/57.8 |
| 4,587,189 | | 5/1986 | Hor et al. | 430/58.8 |
| 4,596,754 | * | 6/1986 | Tsutsui et al. | 430/49 |
| 4,664,995 | | 5/1987 | Horgan et al. | 430/58.65 |
| 4,801,517 | | 1/1989 | Frechet et al. | 430/58.6 |
| 4,806,443 | | 2/1989 | Yanus et al. | 430/56 |
| 4,806,444 | | 2/1989 | Yanus et al. | 430/56 |
| 4,818,650 | | 4/1989 | Limburg et al. | 430/56 |
| 5,030,532 | | 7/1991 | Limburg | 430/56 |
| 5,262,512 | * | 11/1993 | Yanus et al. | 430/56 |
| 5,283,143 | * | 2/1994 | Yanus et al. | 430/58.7 |
| 5,310,613 | * | 5/1994 | Pai et al. | 430/58.6 |
| 5,336,582 | * | 8/1994 | Takegawa et al. | 430/120 |
| 5,356,743 | * | 10/1994 | Yanus et al. | 430/58.6 |
| 5,409,792 | * | 4/1995 | Yanus et al. | 430/58.7 |
| 5,486,439 | * | 1/1996 | Sakakibara et al. | 430/58.45 |
| 5,547,790 | * | 8/1996 | Umeda et al. | 430/58.2 |

FOREIGN PATENT DOCUMENTS

| | | | | |
|---|---|---|---|---|
| 0529877 | * | 3/1993 | (EP) | 430/58.05 |

OTHER PUBLICATIONS

Grant et al, ed, *Grant & Hackh's Chemical Dictionary*, Fifth Edition, McGraw–Hill Book Company, NY (1987) p 150.*

Hannay, N.B., *Solid–State Chemistry*, Prentice–Hall, Inc., NJ (1967) pp 24–25.*

* cited by examiner

*Primary Examiner*—Janis L. Dote
(74) *Attorney, Agent, or Firm*—Oliff & Berridge, PLC

(57) ABSTRACT

A crack resistant, curl-free electrophotographic imaging member includes a charge transport layer comprising an active charge transporting polymeric tetraaryl-substituted biphenyidiamine and a plasticizer.

15 Claims, 1 Drawing Sheet

CRACK-RESISTANT AND CURL FREE MULTILAYER ELECTROPHOTOGRAPHIC IMAGING MEMBER

This is a Continuation of application Ser. No. 08/492,529, filed Jun. 20, 1995, now abandoned.

BACKGROUND OF THE INVENTION

This invention relates in general to electrophotography and in particular, to electrophotoconductive imaging members having crack-resistant multiple layers.

In electrophotography utilizing a liquid development system, an electrophotographic plate, drum, belt or the like (imaging member) containing a photoconductive insulating layer on a conductive layer is imaged by first uniformly electrostatically charging its surface. The imaging member is exposed to a pattern of activating electromagnetic radiation such as light. The radiation selectively dissipates the charge on the illuminated areas of the photoconductive insulating layer while leaving behind an electrostatic latent image on the non-illuminated areas. The electrostatic latent image is developed to form a visible image by applying an electrically charged liquid toner. The resulting visible image is transferred from the imaging member directly or indirectly to a support such as paper. The liquid toner can contain various types of colorant and dye attached to a resin dispersed in an insulating liquid carrier.

Higher speed electrophotographic copiers, duplicators and printers place stringent requirements on photoreceptors. The numerous layers found in many modern photoconductive imaging member belts must be highly flexible, adhere well to adjacent layers, and exhibit predictable electrical characteristics within narrow operating limits to provide excellent toner images over many thousands of cycles.

Long service life is required in an imaging member. Compact imaging machines employ small diameter photoreceptor belt system support rollers. Small diameter support rollers are desirable for simple, reliable copy paper stripping systems that utilize beam strength of copy paper to automatically remove copy paper sheets from the surface of a photoreceptor belt after toner image transfer. Small diameter rollers, e.g. less than about 0.75 inch (19 mm) diameter, raise the threshold of mechanical performance criteria of photoreceptors to a high level. Spontaneous photoreceptor belt material failure becomes a frequent event.

One type of multilayered photoreceptor that has been employed as a belt in electrophotographic imaging systems comprises a substrate, a conductive layer, a charge blocking layer a charge generating layer and a charge transport layer. The charge transport layer may comprise an electrically active small molecule dispersed or dissolved in an electrically inactive polymeric film forming binder. The expression "electrically active" means that the material is capable of supporting the injection of photogenerated charge carriers from the material in the charge generating layer and is capable of allowing the transport of these charge carriers through the electrically active layer to discharge a surface charge on the active layer.

The multilayered type of photoreceptor may also comprise additional layers such as an anti-curl backing layer, an adhesive layer and an overcoating layer.

Photoreceptors may suffer from cracking, crazing, crystallization of active compounds, phase separation of activating compounds and extraction of activating compounds by organic carrier fluid such as isoparaffinic hydrocarbons, e.g. Isopar®, that are commonly employed in an electrophotographic imaging system using liquid developer inks. The effects of carrier fluid can markedly degrade mechanical integrity and electrical properties of the photoreceptor. The organic carrier fluid tends to leach out activating small molecules typically used in the charge transport layers. The leaching process results in crystallization of the activating small molecules, such as arylamine compounds, onto the photoreceptor surface with subsequent migration of arylamines into the liquid developer ink. In addition, the carrier fluid can induce the formation of cracks and crazes in photoreceptor surface. These effects lead to copy defects and shortened photoreceptor life. Degradation of the photoreceptor manifests itself as increased printing defects prior to complete physical photoreceptor failure. Leaching out of the activating small molecule can increase susceptibility of the transport layer to solvent/stress induced cracking when the belt is parked over belt support rollers or when the belt is subjected to dynamic fatigue flexing during imaging process. Cracks developing in charge transport layers during cycling can be manifested as print-out defects adversely affecting copy quality. Furthermore, cracks in the photoreceptor pick up toner particles that cannot be removed in a cleaning step. The particles can subsequently be transferred and deposited onto a receiving member to cause increased background defects on prints. Crack areas are subject to delamination when contacted with blade cleaning devices thus limiting electrophotographic product design. Some carrier fluids promote phase separation of the activating small molecules, particularly when high concentrations of the arylamine compounds are present in a transport layer binder. Phase separation can adversely alter electrical and mechanical properties of a photoreceptor.

Flexing is normally not encountered with rigid, multilayered photoreceptor drum configurations that utilize charge transport layers containing activating small molecules dispersed or dissolved in a polymeric film forming binder. Nonetheless, electrical degradation can be encountered during development with liquid developers. Degradation of these photoreceptors by liquid developers can occur in less than eight hours of use to render a photoreceptor unsuitable for even low quality xerographic imaging purposes.

Photoreceptors having charge transport layers containing charge transporting arylamine polymers are described in the patent literature. These polymers include the products of a reaction involving a dihydroxy arylamine reactant and are described for example in U.S. Pat. Nos. 4,806,443, 4,806,444, 4,801,517, 5,030,532 and 4,818,650, the entire disclosures of these patents being incorporated herein by reference. Although arylamine transporting polymers overcome many of the problem of binder/small molecule systems, they may not meet all of the functional requirements of some sophisticated electrophotographic systems. Specifically arylamine transporting polymers exposed to hydrocarbon ink vehicles can exhibit dynamic fatigue cracking when cycled around narrow diameter rollers. In addition, thermal contraction mismatch can occur during photoreceptor fabrication resulting in a photoreceptor possessing a curl. When forced flat either mechanically or by the application of an opposite curling back coating, stress is applied to the transport layer. This can aggrevate the cracking problem.

In summary, organic based photoreceptors, even those using polymeric arylamine transport materials, can suffer from dynamic fatigue cracking, especially when the photoreceptor is in the form of a belt cycling over small diameter rollers while in contact with an hydrocarbon ink vehicle.

SUMMARY OF THE INVENTION

The present invention relates to an electrophotographic imaging member with improved resistance to bending induced dynamic fatigue cracking and curling. The charge transport layer of the electrophotographic imaging member of the invention comprises an active charge transporting polymer of a tetraaryl-substituted biphenyidiamine and a plasticizer.

BRIEF DESCRIPTION OF THE DRAWING

The accompanying

DESCRIPTION OF PREFERRED EMBODIMENTS

Figure 1:
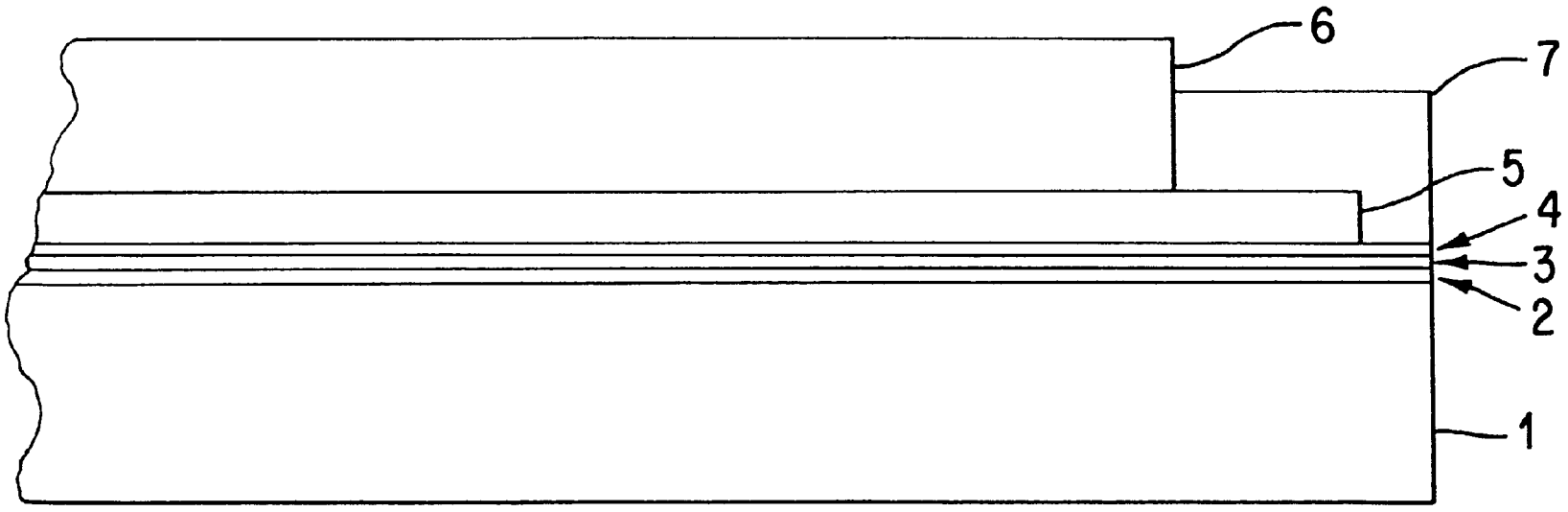
FIG. 1 is a cross-sectional view of a multilayer photoreceptor device of the invention.

A representative structure of an electrophotographic imaging member of the present invention is shown in FIG. 1. The imaging member includes a supporting substrate 1, an electrically conductive, ground plane 2, a charge blocking layer 3, an adhesive layer 4, a charge generating layer 5, and a charge transport layer 6. A ground strip 7 can be provided adjacent the charge transport layer at an outer edge of the imaging member. See U.S. Pat. No. 4,664,995. The ground strip 7 is coated adjacent to the charge transport layer so as to provide grounding contact with a grounding device (not shown) during electrophotographic imaging processes. FIG. 1 shows a cross-sectional view of a flexible photoreceptor belt. The invention relates to imaging members in other configurations such as in the configuration of a drum.

A description of the layers of the electrophotographic imaging member shown in FIG. 1 follows.

The Supporting Substrate

The supporting substrate 1 may be opaque or substantially transparent and may comprise numerous suitable materials having the required mechanical properties. The substrate may further be provided with an electrically conductive surface (ground plane 3). Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. For a belt-type imaging member, the electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as MYLAR, available from E.I. du Pont de Nemours & Co., or Melinex available from ICI Americas Inc.

The preferred thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate 1 for a flexible belt may be of substantial thickness, for example, 200 micrometers, or of minimum thickness, for example 50 micrometers, provided there are no adverse effects on the final photoconductive device. The surface of the substrate layer is preferably cleaned prior to coating to promote greater adhesion of the adjacent layer. Cleaning may be effected by exposing the surface of the substrate layer to plasma discharge, ion bombardment and the like.

The Electrically Conductive Ground Plane

The electrically conductive ground plane 2 (if needed) may be an electrically conductive layer such as a metal layer which may be formed, for example, on the substrate 1 by any suitable coating technique, such as a vacuum depositing technique. Typical metals for a metal layer include aluminum, zirconium, niobium, tantalum, vanadium, hafnium, titanium, nickel, stainless steel, chromium, tungsten, molybdenum, and the like, and mixtures and alloys thereof. The conductive layer may vary in thickness over substantially wide ranges depending on the optical transparency and flexibility desired for the electrophotoconductive member. Accordingly, for a flexible photoresponsive imaging device, the thickness of the conductive layer is preferably between about 20 Angstroms to about 750 Angstroms, and more preferably from about 50 Angstroms to about 200 Angstroms for an optimum combination of electrical conductivity, flexibility and light transmission. The conductive ground plane 3 may be omitted if a conductive substrate is used.

The Charge Blocking Layer

After deposition of any electrically conductive ground plane layer 3, the charge blocking layer 3 may be applied. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized.

The charge blocking layer 3 may include polymers such as polyvinylbutyral, epoxy resins, polyesters, polysiloxanes, polyamides, polyurethanes and the like; nitrogen-containing siloxanes or nitrogen-containing titanium compounds such as trimethoxysilyl propyl ethylene diamine, N-beta-(aminoethyl) gamma-amino-propyl trimethoxy silane, isopropyl 4-aminobenzene sulfonyl titanate, di(dodecylbenzene sulfonyl) titanate, isopropyl di(4-aminobenzoyl)isostearoyl titanate, isopropyl tri(N-ethylaminoethylamino) titanate, isopropyl trianthranil titanate, isopropyl tri(N,N- dimethyl-ethylamino) titanate, titanium-4-amino benzene sulfonate oxyacetate, titanium 4-aminobenzoate isostearate oxyacetate, $[H_2N(CH_2)_4]CH_3Si(OCH_3)_2$ (gamma-aminobutyl methyl dimethoxy silane), $[H_2N(CH_2)_3]CH_3Si(OCH_3)_2$ (gamma-aminopropyl methyl dimethoxy silane), and $[H_2N(CH_2)_3]Si(OCH_3)_3$ (gamma-aminopropyl trimethoxy silane) as disclosed in U.S. Pat. Nos. 4,338,387, 4,286,033 and 4,291,110. A preferred hole blocking layer comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity.

The charge blocking layer 3 should be continuous and have a thickness of less than about 0.5 micrometer because greater thicknesses may lead to undesirable high residual voltage. A blocking layer 4 of between about 0.005 micrometer and about 0.3 micrometer is satisfactory because charge neutralization after the exposure step is facilitated and good electrical performance is achieved. A thickness between about 0.03 micrometer and about 0.06 micrometer is preferred for blocking layers for optimum electrical behavior.

The charge blocking layer 3 may be applied by any suitable technique such as spraying, dip coating, draw bar coating, gravure coating, silk screening, air knife coating, reverse roll coating, vacuum deposition, chemical treatment and the like. For convenience in obtaining thin layers, the charge blocking layer 4 is preferably applied in the form of a dilute solution, with the solvent being removed after deposition of the coating by conventional techniques such as by vacuum, heating and the like. Generally, a weight ratio of blocking layer material and solvent of between about 0.5:100 to about 5.0:100 is satisfactory for spray coating.

The Adhesive Layer

An intermediate layer 4 between the blocking layer and the charge generating or photogenerating layer may be provided to promote adhesion. Preferably, the adhesive layer 5 is characterized by a dry thickness between about 0.01 micrometer to about 0.3 micrometer, more preferably about 0.05 to about 0.2 micrometer.

The adhesive layer may comprise any known adhesive for layers of an electrophotographic imaging member.

The Charge Generating Layer

Examples of photogenerating materials for the photogenerating layer 5 include inorganic photoconductive particles such as amorphous selenium, trigonal selenium, and selenium alloys selected from the group consisting of selenium-tellurium, selenium-tellurium-arsenic, selenium arsenide and mixtures thereof, and organic photoconductive particles including various phthalocyanine pigments such as the X-form of metal-free phthalocyanine described in U.S. Pat. No. 3,357,989; metal phthalocyanines such as vanadyl phthalocyanine, hydroxy gallium phthalocyanine, and copper phthalocyanine; dibromoanthanthrone; squarylium; quinacridones such as those available from du Pont under the tradename MONASTRAL RED, MONASTRAL VIOLET and MONASTRAL RED Y; dibromo anthanthrone pigments such as those available under the trade names VAT ORANGE 1 and VAT ORANGE 3; benzimidazole perylene; substituted 2,4-diamino-triazines such as those disclosed in U.S. Pat. No. 3,442,781; polynuclear aromatic quinones such as those available from Allied Chemical Corporation under the tradenames INDOFAST DOUBLE SCARLET, INDOFAST VIOLET LAKE B, INDOFAST BRILLIANT SCARLET and INDOFAST ORANGE; and the like. Other suitable photogenerating materials known in the art may also be utilized, if desired.

Charge generating layers comprising a polymer binder and a photoconductive pigment such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like and mixtures thereof are especially preferred because of their sensitivity to white light. Particularly preferred are the perylene pigments disclosed in U.S. Pat. No. 4,587,189. Vanadyl phthalocyanine, hydroxy gallium phthalocyanine, metal-free phthalocyanine, and tellurium alloys are also preferred because these materials provide the additional benefit of being sensitive to infrared light.

Any suitable film-forming binder material may be employed as the polymer matrix in the photogenerating layer 5. Typical polymeric film-forming materials include those described, for example, in U.S. Pat. No. 3,121,006. Suitable materials include polycarbonates, polyarylates, polyacrylates, polysulfones, polyvinyl chloride, polyvinylbutyral, polyurethanes, polysiloxanes, styrene-butadiene copolymers and the like.

The photogenerating composition or pigment may be present in the resinous binder in various amounts. Generally, from 5 to about 90 percent by volume of the photogenerating pigment is dispersed in about 95 to 10 percent by volume of the resinous binder. Preferably from about 20 percent by volume to about 30 percent by volume of the photogenerating pigment is dispersed in about 80 percent by volume to about 70 percent by volume of the resinous binder composition. However, certain charge generating pigments are preferably present in the layer in much higher percentages, from greater than 20 percent by volume to between 50 percent and 90 percent by volume. Consequently, with such compositions, the proportion of binder in the charge generating layer is substantially reduced compared to typical photogenerating components. Charge generating pigments which are preferably present in higher concentrations include phthalocyanines and benzimidazole perylenes. The phthalocyanines include vanadyl phthalocyanine, hydroxy gallium phthalocyanine, and metal-free phthalocyanine.

Any suitable and conventional technique may be utilized to mix and thereafter apply a photogenerating layer coating mixture. Suitable techniques include spraying, dip coating, roll coating, wire wound rod coating, and the like. In a preferred technique, the pigment is dispersed in a polymer/solvent solution and applied by solution coating. Drying of the deposited coating may be effected by any suitable conventional technique such as oven drying, infrared radiation drying, air drying and the like, to remove substantially all solvents utilized in applying the coating.

Charge Transport Layer

The charge transport layer 6 is a single component polymeric material having inherent charge transporting capability and comprises a polymeric tetraaryl-substituted biphenyl diamine compound. Suitable polymeric tetraaryl-substituted biphenyl diamine compounds as the charge transport molecules of the compositions of the invention are disclosed in U.S. Pat. No. 5,030,532 to Limburg et al. The disclosure of this patent is totally incorporated herein by reference.

Included among the suitable polymeric tetraaryl-substituted biphenyl diamine compounds are the polymeric reaction products of a tetra-substituted biphenyldiamine represented by the following structure:

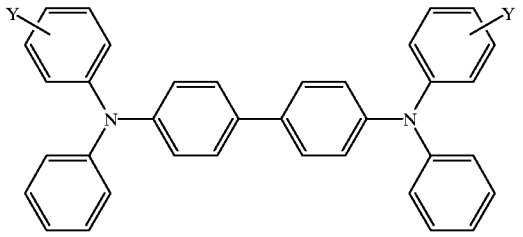

tetra-substituted biphenyldiemine wherein Y is a reactive group such as hydroxy, epoxy, carboxyl, iodo, bromo, or chloro group. The tetra-substituted biphenyldiamine may form poly(carbonates) and poly (esters), of the following polymeric structures:

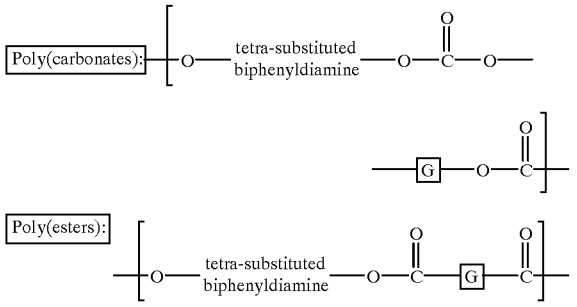

-continued
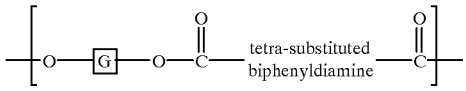
where G equals a hydrocarbon group or a heterocyclic group such as:
—$(CH_2)_n$—, ($n$=1–10); —$(CH_2CH_2O)n$—, (n=1–6);
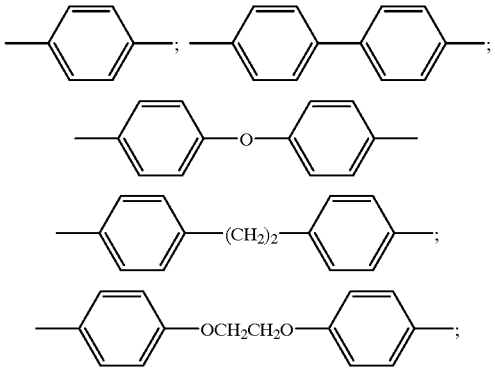
-continued
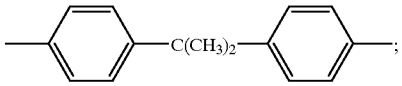
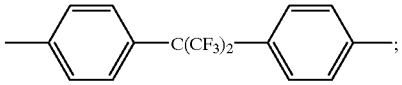
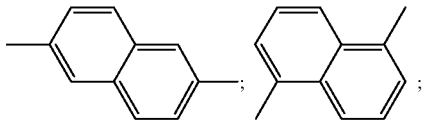
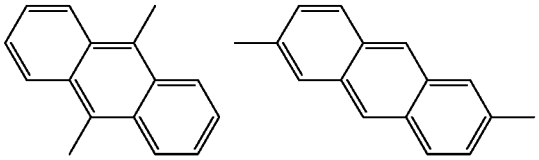
Some exemplary poly(carbonates) include:
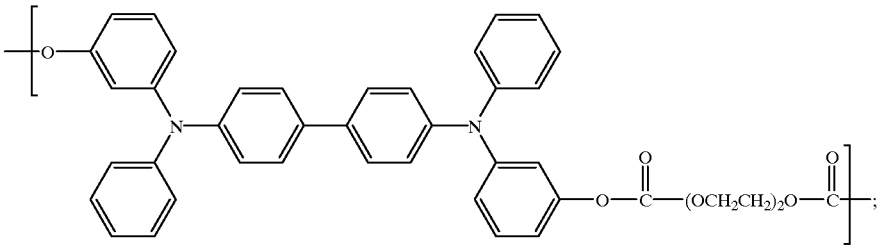
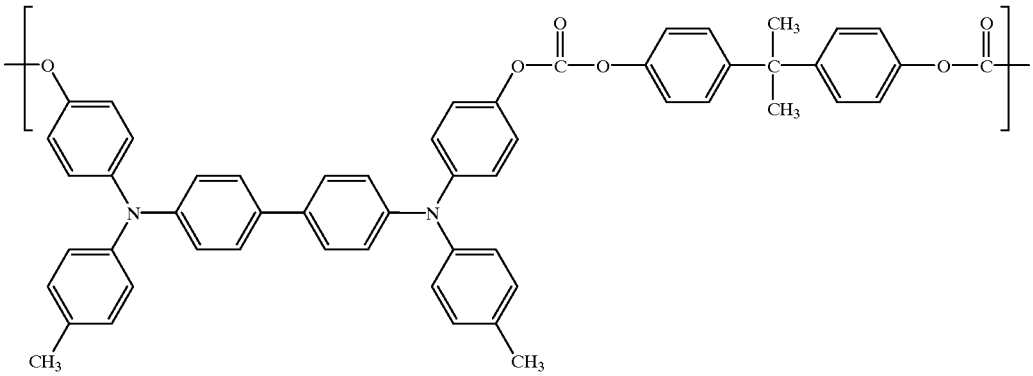

Some exemplary poly(esters) include:

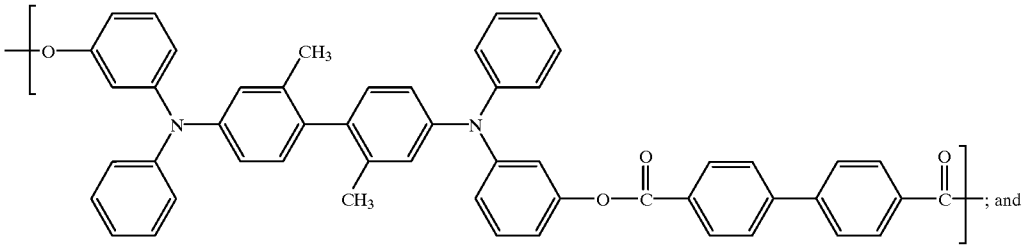

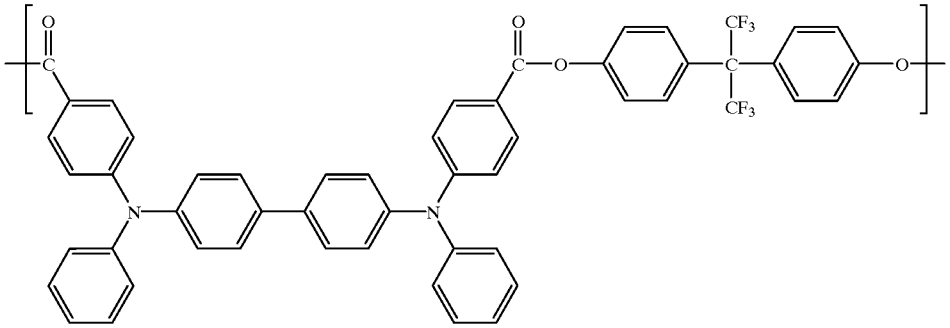

Preferred polymeric tetra-substituted biphenyldiamines are the polymeric reaction products of N,N'-diphenyl-N,N'-bis(3-hydroxyphenyl)-1,1'-biphenyl-4,4'-diamine,

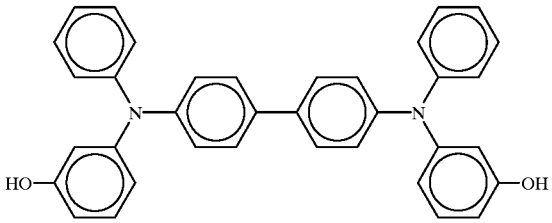

with any of the following:

bisphenol-A-bischloroformate

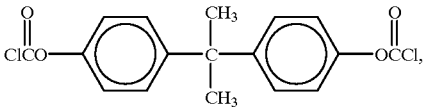

diethyleneglycol bischloroformate

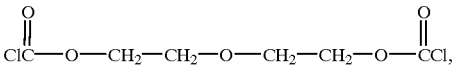

ethyleneglycol biscloroformate

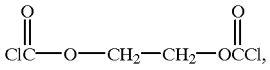

adipoylchloride

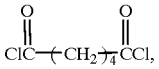

suberoylchloride

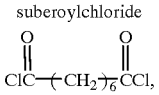

-continued sebacoylchloride

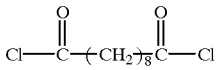

The polymeric reaction products of a tetra-substituted biphenyl-diamine eliminate crystallization problems. However, photoreceptors containing tetra-substituted biphenyldiamine polymeric reaction products as charge transport layers develop cracks when static-bend tested or when subjected to dynamic flexing over small diameter rollers while in contact with a liquid ink vehicle such as Norpar.

Other problems remain. For example, when a charge transport layer is applied by wet coating and dried at an elevated temperature, thermal contraction mismatch between the charge transport layer and substrate can result in greater dimensional shrinkage in the charge transport layer than in the substrate. This causes curling. An anti-curl backing coating can be applied to the back side of the photoreceptor to eliminate curl. However, an anti-curl layer can cause build up of substantial internal stress within the charge transport layer. Built up charge transport layer internal stress may be compounded by induced photoreceptor bending stress as a photoreceptor belt bends and flexes over module rollers. The additional stress may exacerbate the inherent charge transport layer stress to cause cracking when the photoreceptor is exposed to a liquid developer during photoreceptor imaging function.

The present invention relates to an electrophotographic imaging member that includes a polymeric tetraaryl-substituted biphenyidiamine and a plasticizer in the charge transport layer. The plasticizer should have good compatibility with the charge transport layer material without causing phase separation and without causing "bleeding out." The plasticizer should be selected so as to remain dispersed in the film during the photoreceptor processing steps, storage and subsequent use. The presence of plasticizer should not result in any physical/mechanical/electrical degradation of a charge transport layer. Suitable plasticizers include but are not limited to phthalate esters and linear or branched chain esters of the following structures:

(I)

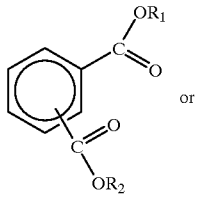

or (II)

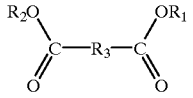

wherein $R_1$ and $R_2$ are linear or branched alkyl groups represented by $C_mH_{2m+1}$ and $C_nH_{2n+1}$, respectively or cyclic groups represented by $C_xH_{2x-1}$ and $C_yH_{2y-1}$, respectively. Both m and n are integers ranging from 1 to 15. If m is selected to be equal to n, then $R_1=R_2$. The values of x and y are between 3 and 8. $R_3$ is a linear or branched alkylene group of 2 to 15 carbon atoms.

Although the ester groups of the phthalic plasticizer shown in the above molecular structure are situated in the ortho position, the phthalic plasticizer selected for the present invention includes ester groups situated in the ortho position and in the meta position and para position.

Examples of suitable plasticizers are listed in the following Table I.

TABLE I

PLASTICIZERS

| Plasticizer | B. P. (° C.) | M. P. (° C.) | M. W. | Density | $n_D$ |
|---|---|---|---|---|---|
| Butyl Octyl Phthalate | 340 | −50 | 334 | 0.996 | 1.4837 |
| Dicapryl Phthalate | 215–240 | −60 | 391 | 0.974 | 1.479 |
| Dicyclohexyl Phthalate | 215* | 62 | 330 | 1.148 | 1.451 |
| Di-(2-ethylhexyl) Phthalate | 231 | −46** | 390 | 0.983 | 1.4850 |
| Diethyl Phthalate | 296 | −3 | 222 | 1.118 | 1.5019 |
| Dihexyl Phthalate | 345 | −45 | 334 | 1.01 | 1.481 |
| Diisobutyl Phthalate | 327 | −50 | 278 | 1.038 | 1.4900 |
| Diisodecyl Phthalate | 255 | −48 | 446 | 0.964 | 1.4836 |
| Diisononyl Phthalate | 252* | −40 | 419 | 0.970 | 1.486 |
| Diisooctyl Phthalate | 233* | −50 | 390 | 0.985 | 1.4850 |
| Dimethyl Phthalate | 282 | 0 | 194 | 1.189 | 1.5168 |
| Ditridecyl Phthalate | 286 | −30 | 531 | 0.952 | 1.4833 |
| Diundecyl Phthalate | 300 | 2 | 475 | 0.953 | 1.479 |
| Di-(2-ethylhexyl) Adipate | 214 | −70 | 371 | 0.9268 | 1.446 |
| Di-(2-ethylhexyl) Azelate | 237 | −76 | 413 | 0.9200 | 1.4464 |
| Di-(2-ethylhexyl) Isophthalate | 241* | −46 | 391 | 0.984 | 1.4875 |
| Dibutyl Sebacate | 344 | −12 | 314 | 0.937 | 1.440 |
| Di-(2-ethylhexyl) Sebacate | 248* | −40 | 427 | 0.915 | 1.448 |
| Diethyl Succinate | 218 | −22 | 174 | 1.048 | 1.419 |

*Boilidng Point at 4–5 mm Hg
**Pouring Point

Other suitable plasticizers include azelates, benzoates, citrates, laurates, 2,4-dichloro toluene and n-octylacetate. Preferably the charge transport layer comprises 0.2 to 50 weight percent plasticizer, more preferably from 4 to 20 weight percent, and most preferably from 6 to 10 weight percent. The remainder of the charge transport layer material comprises a hole transporting polymer such as the aforementioned tetraphenyl diamine polymers.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Ground Strip

The ground strip 7 may comprise a film-forming polymer binder and electrically conductive particles. Cellulose may be used to disperse the conductive particles. Any suitable electrically conductive particles may be used in the electrically conductive ground strip layer 9. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from abut 14 micrometers to about 27 micrometers.

Incorporation of a phthalate plasticizer in the charge transport layer reduces or eliminates photoreceptor curl-up problem and reduces or eliminates liquid developer exposure charge transport layer cracking as well. Application of an anti-curl layer and an overcoating layer may not be required.

If an anti-curl layer is required, it may comprise organic polymers or inorganic polymers that are electrically insulating or slightly semi-conductive. The anti-curl layer can provide flatness and/or abrasion resistance.

The anti-curl coating may be applied as a solution prepared by dissolving the film forming resin and the adhesion promoter in a solvent such as methylene chloride. The solution is applied to the rear surface of the supporting substrate (the side opposite to the imaging layers) of the photoreceptor device by hand coating or by other methods known in the art. The coating wet film is then dried to produce the anti-curl layer.

The optional overcoating layer, if needed, is used to provide the charge transport layer from wear as well as protection against organic liquid exposure. The optional overcoating layer may comprise organic polymers or inorganic polymers that are capable of transporting charge through the overcoat. The overcoating layer may range in thickness from about 2 micrometers to about 8 micrometers, and preferably from about 3 micrometers to about 6 micrometers. An optimum range of thickness is from about 3 micrometers to about 5 micrometers.

The invention will further be illustrated in the following, non-limiting examples, it being understood that these examples are intended to be illustrative only and that the invention in not intended to be limited to the materials, conditions, process parameters and the like recited therein.

COMPARATIVE EXAMPLE

A flexible photoreceptor device is prepared by providing a titanium coated polyester substrate (MELINEX 442, available from ICI Americas, Inc.) having a thickness of 3 mils (76.2 micrometers) and applying thereto, using a ½ mil gap Bird applicator, a solution containing 1 gram gamma aminopropyltriethoxy silane (available from Union Carbide Corporation), 4 grams distilled water, 0.3 gram acetic acid, 74.7 grams of 200 proof denatured alcohol and 20 grams heptane. This layer is then allowed to dry for 5 minutes at 135° C. in a forced air oven. The resulting blocking layer has an average dry thickness of 0.06 micrometer (600 Angstroms) measured with an ellipsometer.

An adhesive layer is then prepared by applying, with a ½ mil gap Bird applicator to the blocking layer, a wet coating containing 0.5 percent by weight based on the total weight of the coating solution of a polyester adhesive (MOR-ESTER 49,000, available from Morton International, Inc.) dissolved in a 70:30 volume ratio mixture of tetrahydrofuran/cyclohexanone. The wet coating of the applied adhesive interface layer is allowed to dry for 5 minutes at 135° C. in the forced air oven. The resulting adhesive interface layer has a dry thickness of 0.05 micrometer (500 Angstroms).

The adhesive interface layer is coated over with a photogenerating layer containing 30 percent by volume of vanadyl phthalocyanine dispersion in 70 percent by volume of VITEL PE-100 copolyester matrix. This photogenerating layer is prepared by introducing 7.6 grams of VITEL PE-100 copolyester (available from Goodyear Tire & Rubber Company) and 160 mls of methylene chloride into a 20 oz. amber bottle. To this solution is added 3.6 grams of purified vanadyl phthalocyanine and 1,000 grams of ⅛ inch (3.2 millimeters) diameter stainless steel shot. This mixture is placed on a ball mill for 72 to 96 hours. Subsequently, 50 grams of this slurry is diluted with 100 mls of methylene chloride and placed on a shaker for 10 minutes. The resulting slurry is applied to the adhesive interface layer by using a ½ mil gap Bird applicator to form a coating layer having a wet thickness of 0.5 mil (12.7 micrometers). However, a strip about 3 mm wide along one edge of the substrate bearing the blocking layer and the adhesive layer is deliberately left uncoated to facilitate electrical contact by a ground strip layer that is applied later. This photogenerating layer is dried at 135° C. for 5 minutes in the forced air oven to form a dry thickness photogenerating layer having a thickness of 0.6 micrometer (6,000 Angstroms).

This coated imaging member web is simultaneously overcoated with a charge transport layer and a ground strip layer using a 3 mil gap Bird applicator. The charge transport layer solution is prepared by introducing into an amber glass bottle 16 grams of an active hole transport polymer and 84 grams of methylene chloride. The hole transport polymer is synthesized and obtained through the condensation of N,N'-diphenyl-N,N'-bis[3-hydroxyphenyl]-[1,1'biphenyl]-4,4'diamine and diethylene glycol bischloroformate as described in U.S. Pat. No. 4,806,443. The active hole transport polymer is designated "poly(ether carbonate)." The resulting mixture is dissolved to give a 16 percent by weight solid in 84 percent by weight methylene chloride solution. This solution is applied onto the photogenerator layer. The approximately 3 mm wide strip of adhesive layer left uncoated by the photogenerator layer is co-coated with a ground strip layer during the charge transport layer coating process.

Both the applied charge transport layer and the ground strip wet coatings are dried at 135° C. for 5 minutes in the forced air oven to form layers of 24 micrometers and 14 micrometers dried thicknesses, respectively. The photoreceptor device, at this point, curls spontaneously upward into a 1½ inch diameter tube.

An anti-curl coating is prepared by dissolving 8.82 grams of polycarbonate resins (MAKROLON 5705, available from Bayer AG) and 0.72 gram of polyester resin (VITEL PE-200, available from Goodyear Tire & Rubber Company) in 90.1 grams of methylene chloride in a glass container to form a coating solution containing 8.9 percent solids. The anti-curl coating solution is applied to the rear surface (side opposite the photogenerator layer and charge transport layer) of the imaging member with a 3 mil gap Bird applicator and dried at 135° C. for about 5 minutes in the forced air oven to produce a dried film thickness of about 13.5 micrometers. The fabricated photoreceptor device is flat and is used to serve as a control.

EXAMPLE I

An invention photoreceptor device having poly(ether carbonate) charge transport layer is prepared using the same material and procedures as described in the control of the Comparative Example, but with the exception that 4 percent by weight of diethyl phthalate plasticizer is incorporated into the matrix of the charge transport layer. To effect charge transport layer plasticizer incorporation, a pre-determined amount of diethyl phthalate is dissolved in the charge transport layer coating solution. Diethyl phthalate is a non-volatile high boiling liquid that remains permanently in the charge transport layer matrix even after drying at elevated temperature. The diethyl phthalate eliminates 90 percent of the photoreceptor curling seen in the control of the Comparative Example. No anti-curl layer is applied to the back of the resulting photoreceptor device.

EXAMPLE II

An invention photoreceptor device having poly(ether carbonate) charge transport layer is prepared in the same manner as described in Example I, except that the charge transport layer contains 8 percent by weight diethyl phthalate. The resulting photoreceptor device has a material structure the same as that illustrated in FIG. 1 and is curl-free. No anti-curl layer is required.

EXAMPLE III

The photoreceptor devices of the Comparative Example I and Examples I and II are tested for contact angle measurement, Young's Modulus (free standing charge transport layer films obtained by its coating solution over a Teflon surface for ease of release of film), coefficient of friction against a polyethylene terephthalate substrate and an elatomeric polyurethane cleaning blade, glass transition temperature (Tg), and seam strength (the seam of each photoreceptor device is prepared by overlapping the two opposite ends of a sheet to above 1–2 mm and ultrasonically welding into an overlapped seam using a 40 KHz horn). The data listed in Table II below show that plasticizing the charge transport layer effectively provides a device that may not require an anti-curl layer and that is free of the deleterious physical and mechanical effects noted in the control of Comparative Example. It is important to note that the reduction in coefficient of surface contact friction against the polyethylene terephthalate substrate will provide ease of photoreceptor webstock (about 6,000 feet web length) roll up after production coating processes; of equally important is that the reduction of coefficient friction seen between the plasticized charge transport layer and the cleaning blade can enhance the blade's cleaning efficiency as well during photoreceptor belt imaging/cleaning processes.

TABLE II

Physical/Mechanical Properties of Photoreceptor

| Plasticizer in Transport Layer | Contact Angle with Water (degrees) | Young's Modulus of Transport Layer | Coefficient of Friction Against Substrate | Coefficient of Friction Against Cleaning Blade | Tg (° C.) | Seam Strength (Kg/cm) |
|---|---|---|---|---|---|---|
| 0% (Control) | 77.0 | 2.54 × 105 psi | 0.51 | 4.25 | 95 | 10.8 |
| +4% diethyl phthalate | 77.1 | 2.51 × 105 psi | 0.48 | 3.31 | 93 | 9.9 |
| +8% diethyl phthalate | 76.8 | 2.53 × 105 psi | 0.46 | 3.06 | 90 | 10.3 |

EXAMPLE IV

The flexible photoreceptor devices of the above Comparative Example and Examples I and II are tested by static bending over a 19 mm roll with constant NORPAR 15 (a straight chain $C_{15}$ liquid hydrocarbon available from Exxon Chemical) exposure. NORPAR 15 is applied directly over the photoreceptor surface. The devices are then examined for cracks using a reflection optical microscope at 100 x magnification. Although the control sample of the Comparative Example develops instantaneous charge transport layer cracking upon direct contact with NORPAR 15, both the invention devices having 4 percent and 8 percent by weight diethyl phthalate plasticized charge transport layer show no evidence of charge transport layer cracking after constant exposure to NORPAR 15 for three weeks.

In an additional testing, a photoreceptor belt fabricated from the sample of Example II (containing 8 percent by weight diethyl phthalate in the charge transport layer) is fatigue cycled in a 2-inch diameter bi-roller belt module for 300,000 cyclic revolutions with constant exposure to NORPAR 15. The photoreceptor belt does not develop charge transport layer cracking. This result further illustrates effective elimination of solvent exposure/charge transport layer cracking problems according to the electrophotographic imaging member fabrication method of the present invention.

While the invention has been described with reference to particular preferred embodiments, the invention is not limited to the specific examples given, and other embodiments and modifications can be made by those skilled in the art without departing from the spirit and scope of the invention and claims.

What is claimed is:

1. An electrophotographic imaging member comprising a supporting substrate; a charge generating layer; and a charge transport layer, said supporting substrate being (1) electrically nonconductive and adjacent an electrically conductive ground plane, wherein said ground plane is between the supporting substrate and the charge generating layer, or (2) electrically conductive, said charge generating layer comprising a polymer binder and a benzimidazole perylene charge generating material, and said charge transport layer consisting of an active charge transport polymer and 0.2 to 50 percent by weight of a plasticizer based on the total weight of the charge transport layer, wherein the active charge transport polymer is a polymeric tetraryl-substituted biphenyldiamine, said polymeric tetraaryl-substituted biphenyldiamine being a polymer of:

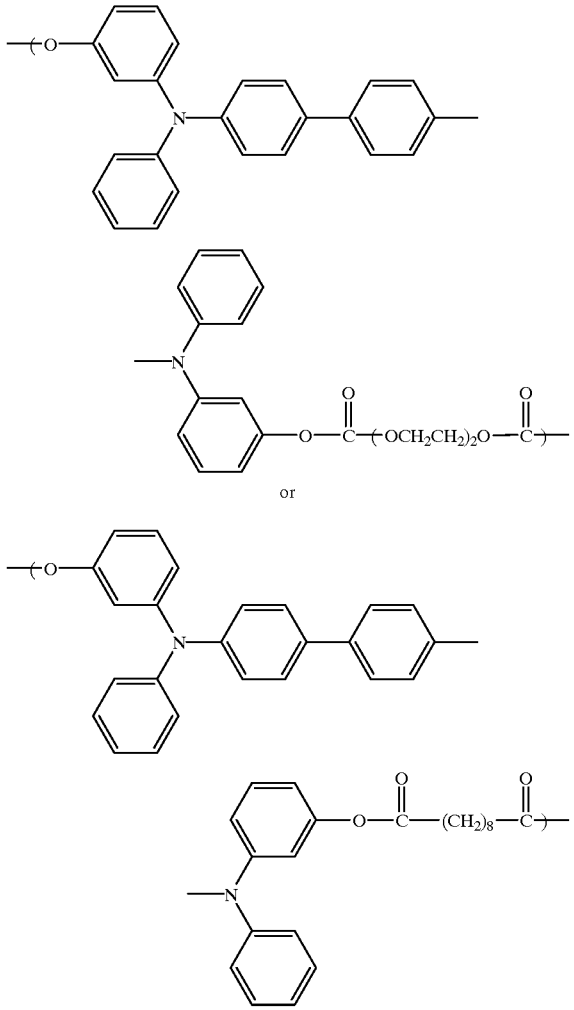

and wherein the plasticizer is an ester of the structure:

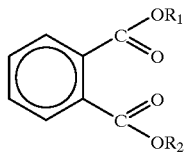

wherein each of $R_1$ and $R_2$ is a linear or branched alkyl group represented respectively by $C_mH_{2m+1}$ and $C_nH_{2n+1}$ wherein m and n are integers of from 1 to 15 or each of $R_1$ and $R_2$ is a cyclic group represented respectively by $C_xH_{2x-1}$ and $C_yH_{2y-1}$, wherein x and y are integers between 3 and 8.

2. The electrophotographic imaging member of claim 1, wherein said polymer binder in said charge generating layer is selected from the group consisting of polycarbonates, polyarylates, polysulfones, polyvinylchloride, polyvinylbutyral, polyurethanes, polysiloxanes and styrene-butadiene copolymers.

3. The electrophotographic imaging member of claim 1, wherein said plasticizer is diethyl phthalate.

4. The electrophotographic imaging member of claim 1, said polymeric tetraaryl-substituted biphenyldiamine being a polymer of:

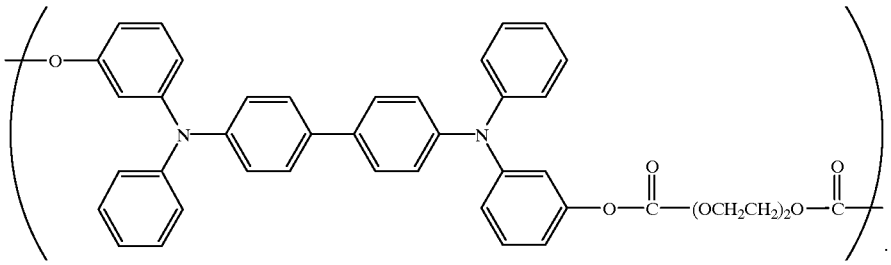

5. The electrophotographic imaging member of claim 1, said polymeric tetraaryl-substituted biphenyldiamine being a polymer of:

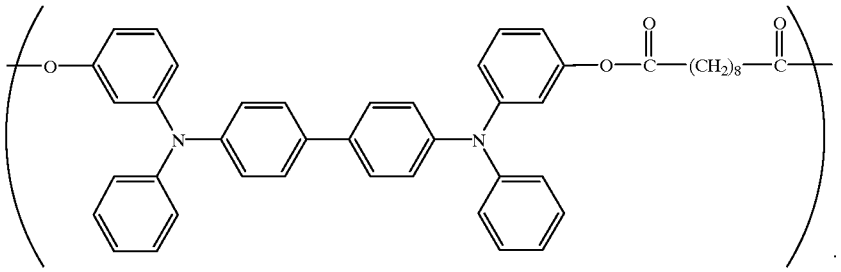

6. The electrophotographic imaging member of claim 1, said charge transport layer having 4 to 20 percent by weight of said plasticizer based on the total weight of the charge transport layer.

7. The electrophotographic imaging member of claim 1, said charge transport layer having 4 to 10 percent by weight of said plasticizer based on the total weight of the charge transport layer.

8. The electrophotographic imaging member of claim 1, said charge transport layer having 6 to 10 percent by weight of said plasticizer based on the total weight of the charge transport layer.

9. The electrophotographic imaging member of claim 1, wherein said member further comprises a charge blocking layer between the supporting substrate and the charge generating layer.

10. The electrophotographic imaging member of claim 9, wherein said charge blocking layer is attached to the charge generating layer by an adhesive layer.

11. The electrophotographic imaging member of claim 1, wherein no anti-curl layer is present on a side of the supporting substrate opposite the charge generating layer.

12. An electrophotographic imaging member comprising a supporting substrate; a charge generating layer; and a charge transport layer, said supporting substrate being (1) electrically non-conductive and adjacent an electrically conductive ground plane, wherein said ground plane is between the supporting substrate and the charge generating layer, or (2) electrically conductive, and said charge transport layer comprising an active charge transport polymer and a plasticizer, wherein the active charge transport polymer is a polymeric tetraaryl-substituted biphenyldiamine, said polymeric tetraaryl-substituted biphenyldiamine being a polymer of:

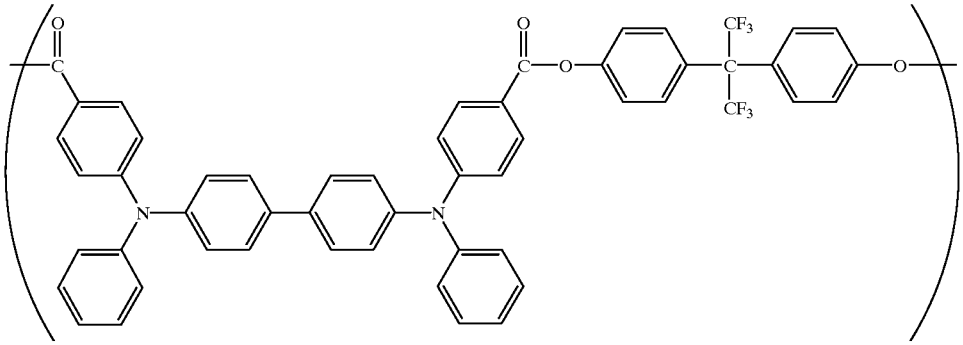

and wherein the plasticizer is an ester of the structure:

(I)

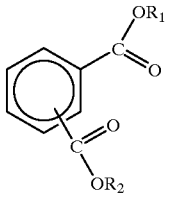

wherein each of $R_1$ and $R_2$ is a linear or branched alkyl group represented respectively by $C_mH_{2n+1}$ and $C_nH_{2n+1}$ wherein m and n are integers of from 1 to 15 or each of $R_1$ and $R_2$ is a cyclic group represented respectively by $C_xH_{2x-1}$ and $C_yH_{2y-1}$, wherein x and y are integers between 3 and 8.

13. The electrophotographic imaging member of claim 12, wherein said charge transport layer comprises 0.2 to 50 percent by weight plasticizer based on the weight of the charge transport layer.

14. The electrophotographic imaging member of claim 12, wherein said charge transport layer comprises 4 to 20 percent by weight plasticizer based on the weight of the charge transport layer.

15. The electrophotographic imaging member of claim 12, wherein said plasticizer is an ester of the structure:

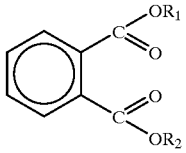

wherein each of $R_1$ and $R_2$ is a linear or branched alkyl group represented respectively by $C_mH_{2m+1}$ and $C_nH_{2n+1}$ wherein m and n are integers of from 1 to 15 or each of $R_1$ and $R_2$ is a cyclic group represented respectively by $C_xH_{2x-1}$ and $C_yH_{2y-1}$, wherein x and y are integers between 3 and 8.

* * * * *